United States Patent [19]

Gaines et al.

[11] Patent Number: 4,546,982

[45] Date of Patent: Oct. 15, 1985

[54] GOLF CARD GAME

[75] Inventors: Mary L. Gaines; Charles J. Gaines, both of Lawton, Okla.

[73] Assignee: Mary L. Gaines, Corp., Lawton, Okla.

[21] Appl. No.: 595,705

[22] Filed: Apr. 2, 1984

[51] Int. Cl.[4] ..... A63F 1/00

[52] U.S. Cl. ..... 273/298; 283/49

[58] Field of Search ..... 273/292, 303, 304, 305, 273/306, 298; 283/49, 50

[56] References Cited

U.S. PATENT DOCUMENTS 1,636,694 7/1927 Jacobs et al. ..... 273/292 X

OTHER PUBLICATIONS

"Games with Playing Cards" by Joseph Leeming, publ. by Franklin Watts, Inc., N.Y., Copyright 1949, pp. 76–80.

"Scarne's New Complete Guide to Gambling" by John Scarne, publ. by Simon and Schuster, N.Y., Copyright 1961, pp. 755–765.

"A Handbook of Game Design" by Ellington et al., publ. by Kagan Page Ltd., London, 1982, pp. 37, 38.

*Primary Examiner*—Anton O. Oechsle

*Attorney, Agent, or Firm*—Kanz, Scherback & Timmons

[57] ABSTRACT

A card game that simulates the game of golf. The game comprises a deck of fifty two cards and a score card. The deck of cards includes eight cards having the numeral zero thereon, eight cards having the numeral ten thereon, and four cards each having a numeral selected from one to nine thereon. The game is played with each player being dealt four cards—two up and two down. Draw and discard stacks are established. When a player "putts", the hand having the lowest total score wins the "hole". Play continues until nine "holes" are played with the player having the lowest total score being the winner.

3 Claims, 2 Drawing Figures

GOLF SCORE SHEET

| NAME | 20 | 22 | 24 | 26 |
|---|---|---|---|---|
| HOLE 1 | | | | |
| 2+ | | | | |
| 2 | | | | |
| 3+ | | | | |
| 3 | | | | |
| 4+ | | | | |
| 4 | | | | |
| 5+ | | | | |
| 5 | | | | |
| 6+ | | | | |
| 6 | | | | |
| 7+ | | | | |
| 7 | | | | |
| 8+ | | | | |
| 8 | | | | |
| 9+ | | | | |
| Total | | | | |

©1983 Mary L.Gaines Corp.

18 30 32 34 32 34 32 34 36

GOLF CARD GAME

BACKGROUND OF THE INVENTION

This invention relates generally to card games for simulating the game of golf. More particularly but not by way of limitation, this invention relates to card game apparatus for simulating a game of golf and to a method of playing such card game apparatus.

U.S. Pat. No. 4,289,315 which issued Sept. 15, 1981 to Vernon L. O'Barr, illustrates a card game that simulates the game of golf and that utilizes a plurality of decks of cards. The game includes a special tray for holding the cards that is pivotal to make the cards more accessible to each player during the game. Each of the cards in this game illustrates a stroke that is utilized in the game of golf and each carries a special message on the back indicating the progress of the player.

U.S. Pat. No. 2,006,521 issued July 2, 1935 to J. E. Stone describes a special deck of cards that are used in a contract bridge game called "whist." According to the disclosure, whist is played like contract bridge in that all of the cards are dealt to the four players who play the game. The special whist cards are different from those of this invention, but the patent has been cited to illustrate that special decks of cards have been utilized in games heretofor.

SUMMARY OF THE INVENTION

The object of this invention is to provide a card game that is similar to golf in that the player having the lowest total score wins, one in which relatively simple rules are followed, and one in which a certain amount of suspense and enjoyment is provided throughout the game.

In one aspect, this invention provides a special deck of cards consisting of a plurality of cards wherein each of the cards has on the front thereof a numeral selected from 0 to 10.

In another aspect, this invention, provides a card game that simulates golf and that includes a plurality of cards each having a numeral selected from 0 to 10 on the front thereof and provides a scorecard upon which each player can record his score for each round or "hole" until at least nine holes are played and that carries a cumulative score until the total score is determined for each player.

In a further aspect of the invention, there is contemplated the provision of a method of playing a simulated game of golf that involves the use of a plurality of cards having a numeral selected from 0 to 10 placed on the front thereof. Four cards are dealt to each player with the remaining cards being placed front down on a horizontal surface and one card turned up adjacent to the remaining cards so that the numeral thereon can be observed by the players. Each player, in turn, has the opportunity to either draw from the remaining cards or select the card turned up. That player must then discard a card from his hand. The process continues until one player believes he has the lowest total of the numerals on the cards in his hand at which point he states "I am putting." The remaining players then have one additional turn to draw and discard. When this is done, the total point count in each hand is recorded on the score card and the low point count for the round is determined winner of that "hole". The foregoing is repeated until at least nine holes have been played with the player having the lowest total score being declared the winner.

BRIEF DESCRIPTION OF THE DRAWING

The foregoing and additional objects and advantages of the invention will become more apparent as the following detailed description is read in conjunction with the accompanying drawing wherein like reference characters denote like parts in all views and wherein.

DETAILED DESCRIPTION OF THE PREFERRED EMBODIMENT

Figures 1, 2:
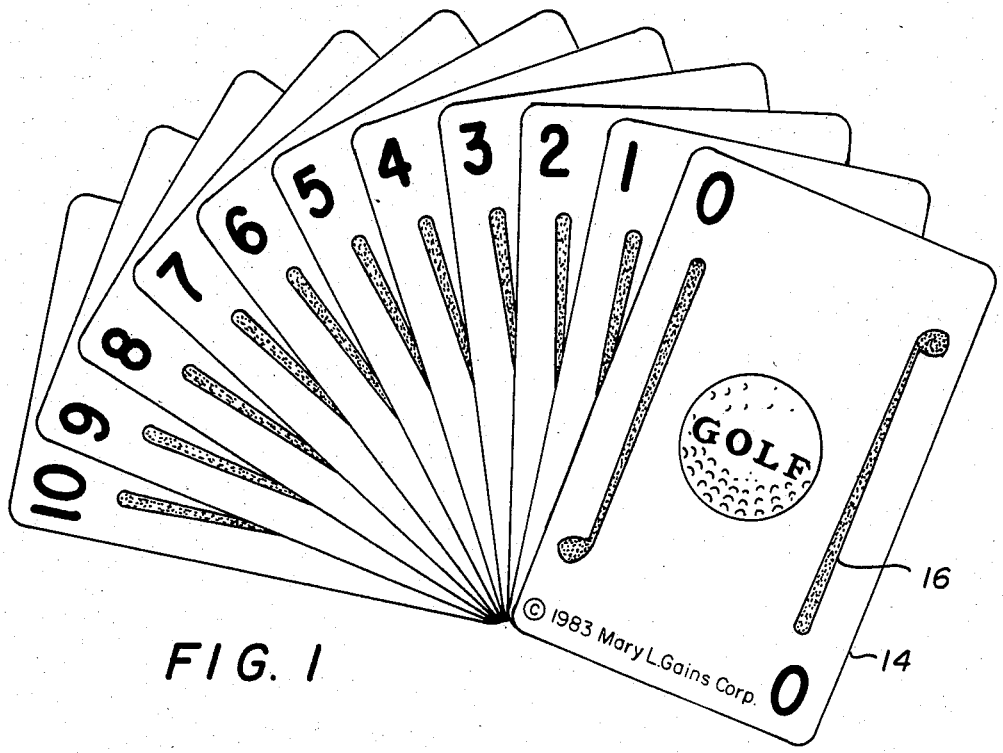
FIG. 1 is a view of the front or portion of the front of each of the cards contained in a deck of cards that is constructed in accordance with the invention.
FIG. 2 is an illustration of a score sheet utilized in combination with the deck of cards illustrated in FIG. 1 for carrying out the method of the invention.

Referring to the drawing and to FIG. 1 in particular, shown therein is a sample of each of the cards utilized in a simulated golf game that is constructed in accordance with the invention. The cards will be referred to hereinafter by the numerals appearing on the front 14 of the cards.

On the front 14 of the cards, and in addition to the numerals, a design 16 is placed thereon for the purpose of decorating the cards. As shown, the design consists of a pair of golf clubs along with a golf ball located in the center of the card. Each of the cards also includes a back which plays no significance in the game of this invention, but may be conveniently utilized for carrying either a decorative illustration or advertising.

A complete deck of the cards includes 52 cards consisting of eight zeros and eight tens along with four each of the cards numbered one through nine.

FIG. 2 illustrates a score sheet 18 for use in the simulated golf game of this invention. As illustrated, the score sheet includes four columns 20, 22, 24 and 26 with one column being for each player participating in the game. There could be more or less players as desired. Extending perpendicularly across the score sheet 18 with respect to the columns 20, 22, 24 and 26 is a line 30 providing space for recording the score of each player for hole number one.

Additional lines 32 extend across the sheet parallel to the line 30 and each is designated by one of the characters 2+, 3+, 4+, etc. These lines are provided so that each player may indicate his score for the respective hole completed.

The sheet 18 also includes lines 34 that are designated 2, 3, 4, 5, etc. These lines are utilized by each player to record the cumulative sum of his scores on the previous hole or holes and to indicate the present total score during the game. The cumulative scoring provides a means by which each player can tell at any time during the game how he stands with respect to all the other players and thus adds suspense to the game as it proceeds.

At the bottom of the score sheet 18 there appears a line extending parallel to the lines 30, 32, and 34 and is designated by the reference character 36. As indicated, the line 36 is for recording the total score for each player after nine holes have been completed.

As is true in the game of golf, the player having the lowest score on each hole is designated the winner of that hole thus, line 30 will indicate the winner of hole number 1 while the winners of each hole subsequent to that can be determined immediately by looking at line 32 for the appropriate hole number. As previously mentioned, the low cumulative score will be indicated on lines 34 for the appropriate holes played.

In playing the simulated golf game of the invention, one of the players is designated as the dealer and he deals a card to each player until each player has received four cards with two of the cards being front down and two cards front up. The dealer then places the remaining cards in the deck front down on the table or other horizontal surface and turns the top card over with its front up so that the numeral thereon can be seen. This card is placed alongside of the remainder of the cards that were not dealt.

The player to the left of the dealer has the option of either taking a card from the remainder of the deck or taking the card that has been turned over by the dealer so that the numeral is visible. That player must then discard either the card he has drawn or discard one of the cards from the cards previously dealt to him. The same procedure is then followed in turn with respect to each player.

When a player decides that he has, what he believes to be the lowest total of the numerals on the cards he holds of any player in the game, he knocks on the table and declares "I am putting". With the exception of that player, each of the other players in turn are permitted to draw and discard one additional time. When this has been completed, each of players totals the numerals on the cards that they have and registers that score on the score sheet. As previously mentioned, the lowest of the scores is the winner of the hole. The cards are then shuffled and redealt with play continuing for successive holes as described.

If the "putter" has the lowest score on the table, his score for that hole is 0. If any other player ties the score of the "putter" or is lower than the "putter", the "putter" must total his cards and add ten penalty strokes to his score.

In the event that no one chooses to "putt", the drawing and discarding continues until there are no remaining in the deck or undealt pile. At this point, each of the players cards are totalled and recorded on the score sheet with the lowest score being declared winner of that hole.

During play of the game, a player may decide that the card he has drawn is lower than one of his front down cards. At this time, he can turn the front down card over and no matter whether it is higher or lower that the card drawn, he must discard the card turned over. The card drawn from the stack is replaced front down.

Upon completion of nine holes or however many holes have been agreed upon, the scores are totalled and the player having the lowest score is declared to be the winner of the game.

To make the game somewhat more interesting penalty points may be accessed if a player looks at either of his front down cards before he decides to replace that card. If he does so, he is accessed a penalty of five strokes which is added to his total score for that hole.

From the foregoing detailed description, it will be appreciated that the simulated golf game described hereinbefore is interesting and amusing. Minor changes and modifications can be made to the cards and designs thereon and the score sheet without departing from the spirit of the invention or the scope of the annex claim.

What is claimed:

1. A method of playing a simulated game of golf using a deck of fifty two cards, each of which has a front and a back and a numeral from 0 to 10 on the front thereof, the method comprising the steps of:

dealing two cards front up and two cards front down to each player;

placing the remaining cards in a stack back side up on a horizontal surface;

turning one card from the remaining cards front side up exposing the numeral thereon and placing said one card adjacent to said stack in a discard stack;

drawing one card from one said stacks by one of said players;

selectively placing one of said drawn cards front down in place of a selected one of said dealt front down cards;

mandatorily discarding the selected front down card onto said discard stack regardless of the values of the numerals on the cards;

discarding one card onto said discard stack by said player;

repeating said drawing and discarding steps by each player in turn;

declaring by one player, "I am putting";

repeating said drawing and discarding steps by the remaining players for one additional turn; and, totaling the numerals on each player's four cards and comparing the totals wherein the player having lowest total is the winner of one simulated hole and if that player is the declarer he receives the total score of zero for the simulated hole.

2. The method of claim 1 and also including repeating each of said steps at least nine times whereby nine holes are completed.

3. The method of claim 3 and also including the steps of:

recording each player's score on each simulated hole;

recording a cummulative score for each player after each simulated hole excluding the first simulated hole; and, comparing said cummulative scores after at least nine simulated holes to determine which player has the lowest cummulative score whereupon that player is declared to be the winner of the game.

* * * * *